US007904974B2

(12) United States Patent
Salomonsson

(10) Patent No.: US 7,904,974 B2
(45) Date of Patent: Mar. 15, 2011

(54) DEVICE FOR ACTIVE TEMPERATURE EQUALIZATION IN A SAUNA ROOM

(75) Inventor: Ulf Salomonsson, Haparanda (SE)

(73) Assignee: Ulf Salomonsson Produktion AB, Haparanda (SE)

( * ) Notice: Subject to any disclaimer, the term of this patent is extended or adjusted under 35 U.S.C. 154(b) by 1028 days.

(21) Appl. No.: 11/663,426

(22) PCT Filed: Jun. 12, 2006

(86) PCT No.: PCT/SE2006/000677

§ 371 (c)(1),
(2), (4) Date: Mar. 21, 2007

(87) PCT Pub. No.: WO2006/135308

PCT Pub. Date: Dec. 12, 2006

(65) Prior Publication Data

US 2008/0092287 A1 Apr. 24, 2008

(30) Foreign Application Priority Data

Jun. 13, 2005 (SE) ..... 0501330

(51) Int. Cl.
*A61H 33/06* (2006.01)

(52) U.S. Cl. ..... 4/524

(58) Field of Classification Search ..... 4/524–534
See application file for complete search history.

(56) References Cited

U.S. PATENT DOCUMENTS

| | | | | |
|---|---|---|---|---|
| 6,311,344 | B2 * | 11/2001 | Komulainen | 4/524 |
| 6,339,854 | B1 * | 1/2002 | Amendt | 4/524 |
| 2006/0184077 | A1 | 8/2006 | Haslauer | |

FOREIGN PATENT DOCUMENTS

| | | | |
|---|---|---|---|
| DE | 3311849 | | 10/1983 |
| DE | 19930652 | | 1/2001 |
| DE | 20 2005 000279 | | 5/2005 |
| GB | 1196371 | | 6/1970 |
| JP | 08 336571 | | 12/1996 |
| RU | 2119324 | C1 | 9/1988 |
| RU | 2007984 | C1 | 2/1994 |
| SU | 1650137 | A1 | 5/1991 |
| WO | WO 2004/084791 | | 10/2004 |

OTHER PUBLICATIONS

RU Office Action dated Apr. 9, 2010 in corresponding 2007120067.

* cited by examiner

*Primary Examiner* — Huyen Le
(74) *Attorney, Agent, or Firm* — Young & Thompson

(57) ABSTRACT

A device (1*a*) for positioning next to an existing sauna heater (3). Device (1*a*) is equipped with an air duct (2') which is designed to conduct air from a level close to the floor in a sauna to a location close to the upper part of the sauna heater. The air from the floor (91) will be combined with the hot air from sauna heater (3'). The device will increase the airflow (92) down towards the lower parts of the sauna, which results in a more even temperature distribution and a more comfortable sauna experience.

9 Claims, 4 Drawing Sheets

DEVICE FOR ACTIVE TEMPERATURE EQUALIZATION IN A SAUNA ROOM

TECHNICAL AREA

The invention pertains to devices and systems for increased air circulation in a sauna room.

PRIOR ART

A typical sauna room is equipped with a sauna heater, at least two horizontal sauna shelves, an air inlet and an air outlet. Sauna heaters are also referred to as heating units, ovens and sauna ovens.

There are many different theories regarding the positioning of air inlets and outlets respectively. The positioning of air inlets and air outlets in the wall is generally considered to be a factor that affects the air circulation in the sauna room. A known problem with sauna bathing is that it is hotter, and often much hotter, on the top shelf compared to the bottom one. A sauna shelf is also sometimes called a bench. Hot air rises, which is in part a natural process, but through, among other things, the positioning of said outlets, an attempt is made to more evenly distribute the generated heat. One of the purposes of the airflow in the sauna room, which results from the draft between the outlets, is to provide a more even distribution of the heat in the sauna room. One problem with significant airflow is that the energy spent to maintain a certain temperature will increase compared to a situation with less airflow. Another problem related to high volume airflow is the issue of maintaining constant humidity in the sauna room, since humidity is also vented out.

Atmospheric humidity is another parameter that is important to sauna bathing. DE 199,30,652 describes a facility with an adjustable electric sauna heater, equipped with an integrated fan. The fan is positioned under the heating elements in the sauna heater. Airflow reflectors are positioned at certain locations in the sauna room. The sauna heater is equipped with a thermostat control unit, which controls incoming air and water flow automatically, in order to maintain a set relative humidity level in the room. However, one remaining problem is that, as the airflow passing the heating elements increases significantly, the temperature in an integrated stone basket decreases, which makes it more difficult to generate the necessary steam when water is poured onto the stone basket. One other remaining problem is that when air is forced through the heating elements, there will be a risk of heat shock in the sauna room. In order to prevent this, an air outlet is installed in connection with the heater, as well as an air outlet.

DE3311849 demonstrates an electric sauna heater, specifically for a sauna in a bath house, which is separated into two separate parts, a stone basket and an air duct. The stones in the stone basket are heated by the heating elements, which are controlled by a thermostat. The sauna air is initially heated by heating elements located in the air duct. The purpose of the sauna heater is to increase the extraction of humidity compared to other heater units.

Another problem arising in connection with sauna bathing facilities is the issue of filling the sauna heater's stone basket with stones of the right type, of the correct size and in an optimal manner for various sauna rooms.

PURPOSE AND SUMMARY OF THE INVENTION

One purpose of the invention is to design a device that provides a sauna room with active thermoregulation, which provides a more even temperature distribution in the sauna room in a more energy-efficient manner.

This purpose is achieved by means of a device based on patent claim 1. Such a device includes an air duct designed to conduct air from a level close to the sauna room floor to a location in the vicinity of the upper part of a sauna heater. In addition, the device is equipped with a fan. The air duct lacks heating elements, and is thus separated from the air duct that passes by the heating elements and the stone basket in the sauna heater.

An additional purpose of the invention is to design a sauna heater that provides a sauna room with active thermoregulation, which provides a more even temperature distribution in the sauna room, as well as an active reduction of the room temperature, in a more energy-efficient manner.

This objective is achieved in the sauna heater based on the attached patent claims. This type of sauna heater includes an air duct, the purpose of which is to conduct air from a level close to the floor in the sauna room, to a location close to the upper part of the sauna heater. In addition, the sauna heater is equipped with a fan. The air duct lacks heating elements, and is thus separated from the air duct that passes by the heating elements and the stone basket in the sauna heater.

One benefit of the invention is that it enables sauna bathing with basically the same temperature on the upper shelf of the sauna room as on the lower shelf.

Furthermore, the invention allows sauna rooms to be built without needing to consider the possible positioning of the air inlet and outlet. The temperature equalisation in the sauna room is not dependent on the air draft between the two outlets.

Another benefit of the invention is that it enables active thermoregulation and heat distribution with significantly less admission of inlet air compared to known sauna systems and devices. This decreases the total energy required for the heating of the sauna room.

The stones in the sauna oven's stone basket require a certain minimum period to reach the temperature required for efficient evaporation. In sauna rooms that are not equipped with a device or sauna heater, as described in the invention, this means that it is not possible to utilise the evaporation capacity due to the excessively intense heat. The invention actively reduces temperature generation by means of effective heat distribution. This, in turn, creates the necessary conditions for heat release, in the form of steam, from the stone basket, which allows for the utilisation of the accumulated evaporation capacity. This is a manifestation of increased efficiency in the utilisation of the heating power generated. The previously known sauna room systems lower the temperature through ventilation, which results in lower thermal efficiency from the generated heating power. In a sauna room utilising the invention, the energy will basically be accumulated throughout the entire sauna room.

An additional benefit of the invention is that it allows comfortable sauna bathing in the lower section of the sauna as well. This makes it easier for physically handicapped individuals and movement-challenged older persons to enjoy a comfortable sauna bath. There is also a shorter period from the time the heater is turned on until a comfortable temperature has been reached in the lower part of the sauna room. Another result of the invention is that the effect of evaporating water from the stones in the heater will be stronger compared to using prior art already known devices and heaters. The lower temperature in the upper part of the sauna room results in a lower degree of evaporated water absorption, which will instead be distributed to a lower level in the sauna room. This means that the sauna bathing experience, with the aid of the invention, will also be more enjoyable on a lower level in the sauna room.

The invention also has the benefit that the improved temperature distribution produces a significant reduction in surface temperatures, e.g. at the ceiling level. The reason for this is that the hot airflow from the heater's heating elements will combine with cooler air from a lower level. This results in a longer lifespan for the ceiling materials. This is also positive from a safety perspective.

DESCRIPTION OF FIGURES

The invention will be explained in more detail with reference to the attached figures, where

FIG. 6 shall be studied as part of prior art already known technology.

FIG. 7 shows that the heating of the sauna room is significantly more even with the device than that which can be seen from the temperature graphs in FIG. 6, where the sauna room lacks the device.

DESCRIPTION OF THE EMBODIMENTS

Figure 1:
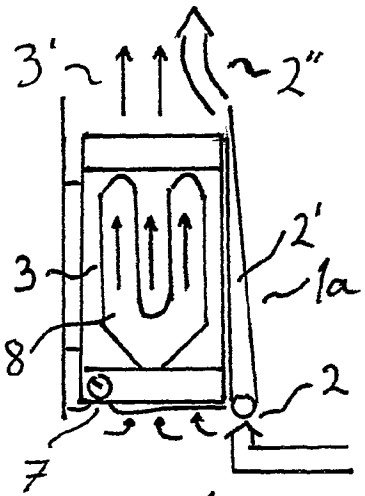
FIG. 1 shows a sauna heater where one embodiment of the device is placed in close proximity to the sauna heater. In this embodiment, the device is an accessory designed to be installed in connection with a previously installed sauna heater in the sauna room.

FIG. 1 shows a sauna heater 3 where one embodiment of device 1*a* is positioned in close proximity to sauna heater 3. In this embodiment, device 1*a* is an accessory designed to be positioned in close proximity to a previously installed sauna heater 3 in sauna room 90. The device includes a fan 2, which is placed in the air duct 2' of the device 1*a*. Alternatively, fan 2 shall be connected to air duct 2'. Air duct 2' is designed to conduct air from a location close to the floor to a location close to the upper part of sauna heater 3, where the air is forced by fan 2, which is turned on when device 1*a* is operating. The upper part of device 1*a* is equipped with an exhaust, which should preferably be designed so that the airflow is directed, at least partially, to the area above the heating element in sauna heater 3. The airflow 3', which has passed heating elements 8, and airflow 2", which has passed through air duct 2', are mixed on their way up towards the ceiling. Since device 1*a* is placed in proximity to sauna heater 3, the air passing through the air duct will be heated to some extent, which, in itself, contributes to airflow 2". However, the primary part of airflow 2" is dependent on the forced airflow caused by fan 2. The air in air duct 2' is heated somewhat during the transport, while the heat in sauna heater 3 is generated by heating element 8 in a space other than air duct 2'. But the primary purpose of positioning air duct 2' in proximity to sauna heater 3 is to combine the air from air duct 2' with the hot air that has passed heating element 8 in the area above the sauna heater 3.

The type of fan 2 is preferably a commonly available fan, which can also be used, for example, to provide ventilation in bathrooms. While operating, fan 2 is preferably connected through a terminal block in connection with thermostat 7 on sauna heater 3. However, fan 2 is not controlled by thermostat 7.

Figure 2:
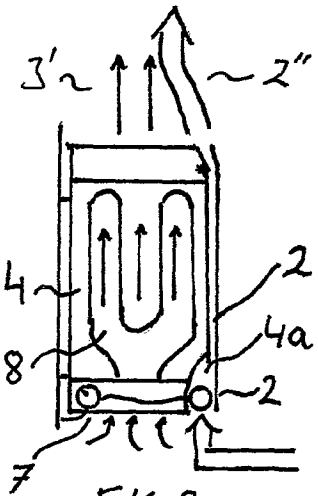
FIG. 2 depicts an alternative embodiment of the device, which is integrated into a sauna heater.

FIG. 2 depicts an embodiment of the invention in the form of a sauna heater 4 where fan 2 and another air duct 2' are incorporated into sauna heater 4. This is in addition to the customary first air duct, which generates airflow 3', which passes heating element 8 in sauna heater 4.

Figure 3:
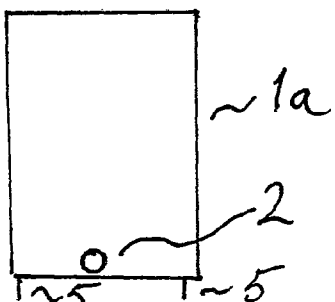
FIG. 3 shows the embodiment of the device as an accessory, viewed from the front.

FIG. 3 shows the embodiment of the device 1*a* as an accessory, viewed from the front. FIG. 3 is related to the embodiment of the device shown in FIG. 1. The view is very schematic and intends to show that in this embodiment device 1*a* covers, completely or almost completely, the front section of sauna heater 3. Device 1*a* may, at the lower section at the bottom of device 1*a*, at fan 2, be equipped with an air gap, where the air gap is narrower than the base of device 1*a*. Alternatively, the bottom of device 1*a* may be equipped with a number of holes. One reason for this is to create an ejector effect in the flow. FIG. 3 shows that certain embodiments of device 1*a* may have feet 5 or supports 5 for positioning on the floor. Many other embodiments of device 1*a* are possible.

Figure 4:
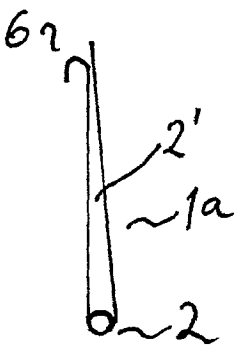
FIG. 4 shows a view from the side of the device, with hooks intended to hang from a previously installed sauna heater in a sauna room.

FIG. 4 shows a simplified view from the side of device 1*a*, with hooks 6 intended to hang from a previously installed sauna heater 3 in a sauna room.

Figure 5:
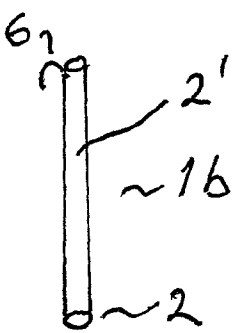
FIG. 5 depicts an alternative embodiment of the device as an accessory, where the device is primarily cylindrical in shape.

FIG. 5 depicts an alternative embodiment of the device as an accessory, where the device is primarily cylindrical in shape.

Figure 6:
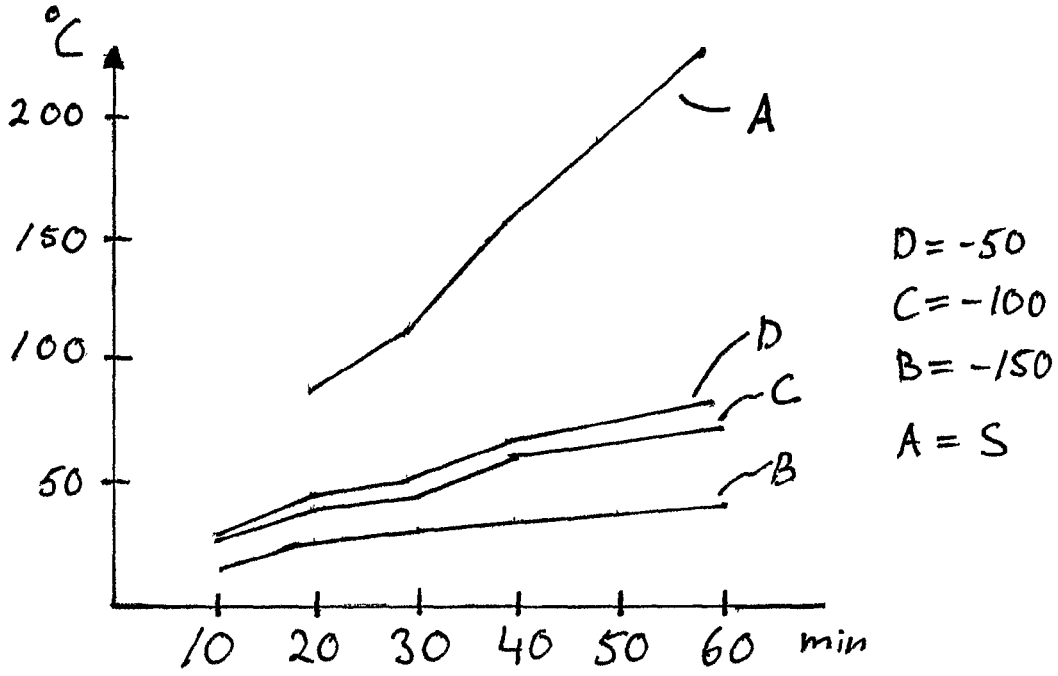
FIG. 6 shows a number of temperature curves for the heating of a sauna room at various points from the ceiling. These temperature curves are related to a sauna room without the device in the invention.
Figure 8:
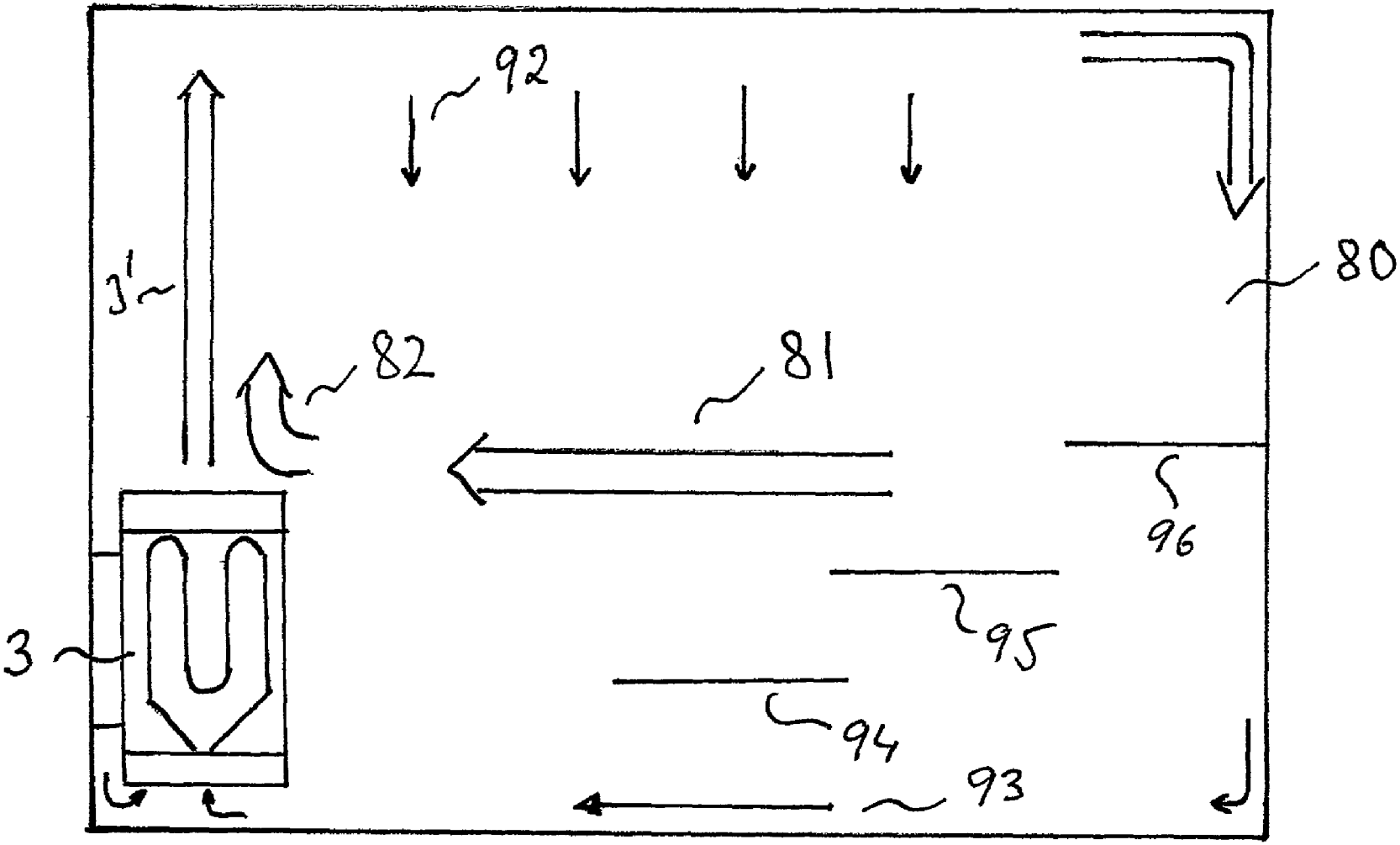
FIG. 8 is an overview of a sauna room without the device based on the invention. The figure shows the airflows in the sauna room.

FIG. 6 shows a number of temperature curves, A, B, C and D, for the heating of a sauna room 80 at various points from the ceiling. These temperature curves are related to a sauna room 80, which is illustrated in FIG. 8, without a device based on the invention. FIG. 6 shall be studied as part of already known technology. The curve marked A indicates measured values of the stone basket in sauna heater 3. Curve B indicates the temperature 150 cm below the ceiling, curve C 100 cm below the ceiling and curve D 50 cm below the ceiling.

Figure 7:
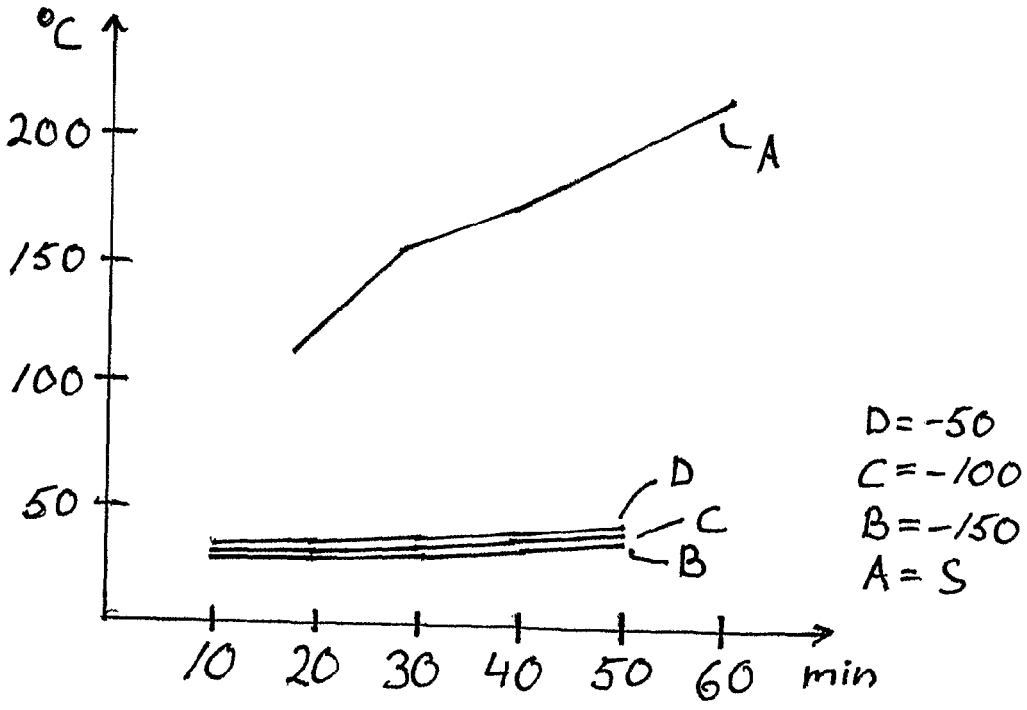
FIG. 7 shows a number of temperature curves for the heating of a sauna room at various points from the ceiling. The measurements are taken in a sauna room, equipped with a device based on the invention.
Figure 9:
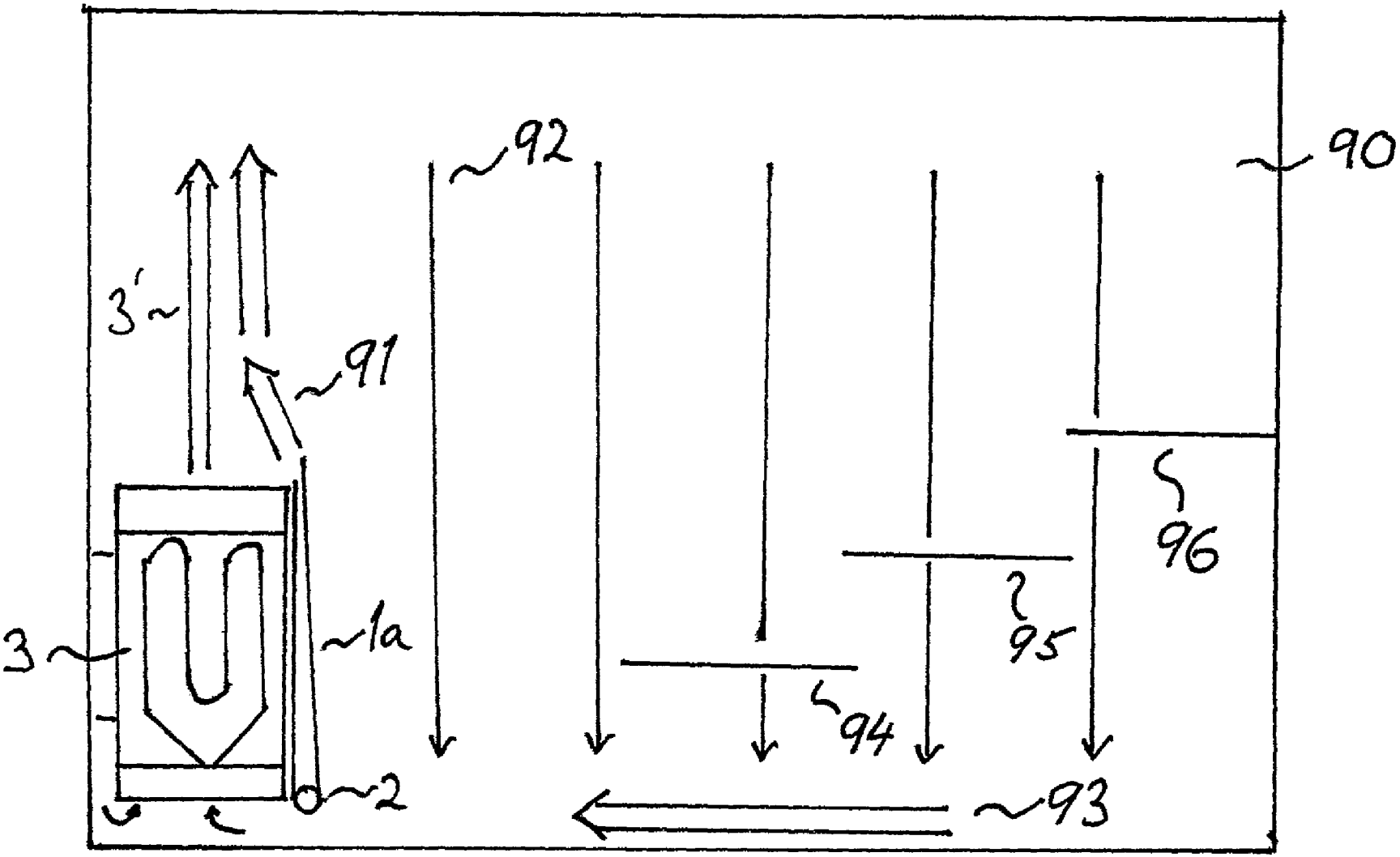
FIG. 9 is an overview of a sauna room equipped with the device based on the invention. The figure shows the airflows in the sauna room.

FIG. 7 shows a number of temperature curves for the heating of a sauna room 90 at various points from the ceiling. The measurements are performed in a sauna room 90, equipped with a device based on the invention. The airflow in such a sauna room 90 is indicated in FIG. 9. The curve marked A indicates measured values for the stone basket in sauna heater 3. Curve B indicates the temperature 150 cm below the ceiling, curve C 100 cm below the ceiling and curve D 50 cm below the ceiling. FIG. 7 shows that the heating of sauna room 90 is significantly more even with device 1*a* than that which can be seen from the temperature curves B, C and D, in FIG. 6, where the sauna room lacks device 1*a*.

FIG. 8 is an overview of a sauna room without the device based on the invention. In other words, FIG. 8 shall be interpreted as part of already known technology. The figure shows the airflows in the sauna room. This sauna is equipped with three shelves, 94, 95, 96, at different heights. FIG. 8 shows that in a traditional sauna room 80, a major part of air circulation occurs in the upper part of the sauna. This results in the temperature being strongly layered vertically in the sauna room. This is also evident from FIG. 6. The ceiling is where cooling down takes place, which leads to a certain degree of downward flow 92 along the entire ceiling. An essential part of the airflow from the sauna heater does not turn downwards until it reaches the corners of the sauna room. It is a well-known fact that the temperatures at the seating places in the corners are higher than at other seating places.

FIG. 9 is an overview of a sauna room 90 equipped with the device based on the invention. The figure shows the airflow in sauna room 90. The downward airflow 92 at the ceiling is higher than in the sauna room shown in FIG. 8. The flow 93 along the floor next to fan 2 is significantly higher than the corresponding flow 93 in FIG. 8. These airflow differences are due to the forced airflow caused by the device or the sauna heater. In this manner, the temperature in the upper part of the sauna room is decreased, and increased in the lower part, compared to traditional sauna rooms 80.

The scope of the invention shall not be limited by said embodiments or the attached figures. The invention can be varied in many different ways within the framework of the attached patent claims.

The invention claimed is:

1. A device (1*a*) for even temperature distribution in a sauna room (90), comprising:

an air duct (2') which is designed to conduct air from a location close to the floor to a location close to the upper part of a sauna heater (3);

a fan (2) being positioned in the air duct (2'), alternatively in connection with the air duct (2');

the air duct (2') lacking heating elements; and positioning fixtures for the installation of the device (1*a*) as an accessory to the sauna heater (3), where the positioning fixtures are one of hook-shaped (6) and foot-like (5), and designed for hanging the device (1*a*) from the sauna heater (3).

2. A sauna heater (4), which includes a first air duct, through which an airflow (3') is designed to be generated during operations, by means of heating elements in the first air duct characterised by the sauna heater (4) incorporating a second air duct (2');

a fan (2) being positioned in the second air duct (2'), alternatively in connection with the second air duct (2');

the second air duct (2') lacking heating elements.

3. A sauna heater (4) according to claim 2 characterised by the fan motor being electrically connected to a terminal block, or a similar unit, in the sauna heater, which is also connected to the heating elements.

4. A device (1*a*) for even temperature distribution in a sauna room (90), comprising:

an air duct (2') which is designed to conduct air from a location close to a floor to a location close to an upper part of a sauna heater (3);

an upper part of the device (1*a*) being equipped with an exhaust designed so that the airflow is directed when mounted on a sauna heater (3), at least partially, to the area above a heating element in the sauna heater; and a fan (2) positioned in the air duct (2'), alternatively in connection with the air duct (2'), the air duct (2') lacking heating elements, wherein the air from air duct (2') is combined with hot air, that has passed the heating element (8) in the sauna heater (3), in the area above the sauna heater (3).

5. The device (1*a*) of claim 4, further comprising positioning fixtures for the installation of the device (1*a*) as an accessory to the sauna heater (3).

6. The device (1*a*) of claim 5, wherein the positioning fixtures are hook-shaped (6), and designed for hanging the device (1*a*) from the sauna heater (3).

7. The device (1*a*) of claim 5, wherein the positioning fixtures are foot-like (5).

8. A sauna heater (3), which includes a first air duct, through which an airflow (3') is designed to be generated during operations, by heating elements in the first air duct, wherein the sauna heater comprises the device of claim 4.

9. The sauna heater of claim 8, wherein a motor for the fan is electrically connected to a terminal block in the sauna heater, which is also connected to the heating elements.

* * * * *